US006994572B2

(12) United States Patent
Baker et al.

(10) Patent No.: US 6,994,572 B2
(45) Date of Patent: Feb. 7, 2006

(54) APPARATUS, SYSTEM, AND METHOD FOR COMPONENT DEACTIVATED INTERLOCK

(75) Inventors: Bruce E. Baker, Round Rock, TX (US); Martin Joseph Crippen, Apex, NC (US); Francis A. Kuchar Jr., Raleigh, NC (US); Peter Andrew Smith, Cary, NC (US); Brian Alan Trumbo, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 81 days.

(21) Appl. No.: 10/723,111

(22) Filed: Nov. 26, 2003

(65) Prior Publication Data

US 2005/0112923 A1 May 26, 2005

(51) Int. Cl.
*H01R 13/44* (2006.01)

(52) U.S. Cl. ..... 439/137; 439/911; 439/924.2

(58) Field of Classification Search ..... 439/135–150, 439/489, 911, 59, 924.2; 200/50.21, 50.31, 200/50.28; 361/754, 798
See application file for complete search history.

(56) References Cited

U.S. PATENT DOCUMENTS 4,133,022 A * 1/1979 Moore et al. ..... 361/801
4,482,938 A * 11/1984 Norden ..... 361/823
4,483,178 A * 11/1984 Miille ..... 73/708
4,738,629 A * 4/1988 Newman ..... 439/137
4,872,212 A * 10/1989 Roos et al. ..... 361/818
4,971,563 A * 11/1990 Wells, III ..... 439/61
5,238,423 A * 8/1993 Hillis et al. ..... 439/259
5,518,411 A * 5/1996 Belleci ..... 439/141
5,675,475 A * 10/1997 Mazura et al. ..... 361/798
5,708,552 A * 1/1998 Han et al. ..... 361/799
5,735,701 A * 4/1998 Jarrett ..... 439/147
5,746,326 A * 5/1998 Hong ..... 211/41.17
5,751,558 A * 5/1998 Gullicksrud et al. ..... 361/801
5,967,824 A * 10/1999 Neal et al. ..... 439/342
6,115,258 A * 9/2000 Hoyle et al. ..... 361/752
6,127,639 A * 10/2000 Greco et al. ..... 200/293
6,191,474 B1 * 2/2001 Kinsman et al. ..... 257/693
6,272,010 B1 * 8/2001 Schmitt ..... 361/685
6,307,754 B1 * 10/2001 Le et al. ..... 361/796
6,537,089 B1 * 3/2003 Montague ..... 439/145
2004/0043649 A1 * 3/2004 O'Connell et al. ..... 439/135
2004/0147148 A1 * 7/2004 Ng et al. ..... 439/137

* cited by examiner

*Primary Examiner*—Tho D. Ta
*Assistant Examiner*—Larisa Tsukerman
(74) *Attorney, Agent, or Firm*—Kunzler & Associates

(57) ABSTRACT

The invention provides an apparatus, system, and method for enabling the installation of an installable device configured with a required component in a receiving device. A component deactivated interlock obstructs the installation of the installable device when not configured with the required component. The invention makes use of an extendable and retractable plunger disposed upon the installable device, a stop barrier disposed upon the receiving device, and an actuator disposed upon the required component. The plunger normally extends beyond the installable device, and upon contacting the stop barrier of the receiving device obstructs the installation. Upon a physical connection of the required component with the installable device, the actuator retracts the plunger, thereby enabling the installation of the installable device.

28 Claims, 7 Drawing Sheets

APPARATUS, SYSTEM, AND METHOD FOR COMPONENT DEACTIVATED INTERLOCK

BACKGROUND OF THE INVENTION

1. The Field of the Invention

The present invention relates to installing devices and more particularly, to the component-enabled installation of properly configured devices.

2. Description of the Related Art

Installable devices such as electrical circuit boards, optical interconnections, and mechanical components are frequently installed in receiving devices such as cabinets, panels, and enclosures. Typically, the installable device must be properly configured in order to function properly and safely within the receiving device. Configuring an installable device may include adding a required component. Installable devices that lack required components may fail to function, damage other devices, or injure an operator. Required components may include safety covers, peripheral devices, mechanical connections, electrical connections, hydraulic connections, or pneumatic connections, for instance.

For example, according to the requirements of well accepted standards such as UL 1950, 3$^{rd}$ edition, for the safety of information technology equipment, an electrical enclosure must prevent access to a hazardous voltage or a hazardous energy level. Typically, an installable device such as a circuit board with a hazardous voltage or energy level is enclosed with a safety cover, so that no hazardous components can come in contact with an operator. The safety cover prevents operator contact with the hazardous components of the installable device. The safety cover is a required component of the installable device and a receiving device such as a circuit board enclosure should not receive the circuit board installable device if the circuit board installable device is not configured with the safety cover.

The required component of an installable device may be removed for maintenance. For example, an installable device such as a circuit board may be populated with components such as processors, memory, disk storage and network controllers. Some of the circuit board components may be field replaceable for maintenance or upgrade. Replacing circuit board components may entail removing the circuit board installable device from the receiving device and removing a required component such as a safety cover.

If after replacing a component, the operator neglects to re-install the required component safety cover and attempts to install the circuit board, the operator is subject to a potential safety hazard. Therefore, it is necessary to have means for obstructing installation of the circuit board installable device in a receiving device when the required component safety cover is not in place.

Interlock systems have been produced that prevent an operator from performing an unauthorized or unsafe operation such as installing a potentially hazardous installable device without a required component. A properly designed interlock system will obstruct installation of the installable device lacking a required component. Unfortunately, available interlocks such as electrical, optical and mechanical interlocks require the use of an electrical power source for activation. Before installation, an installable device such as a circuit board cannot activate an interlock that requires electricity.

To obstruct installation of an installable device when electrical power is not available, mechanical interlocks are often employed. Mechanical interlocks are generally key interlocks with a lock that is released by a key. Unfortunately, key interlocks can be deactivated to allow the installation of an installable device even if a required component such as safety cover is not attached.

Consequently, a need exists for a component deactivated interlock apparatus, system, and method for enabling the installation of an installable device properly configured with a required component. Beneficially, such apparatus, system, and method would prevent the installation of an installable device lacking a required component.

SUMMARY OF THE INVENTION

The various elements of the present invention have been developed in response to the present state of the art, and in particular, in response to the problems and needs in the art that have not yet been fully solved by currently available installable devices. Accordingly, the present invention has been developed to provide a component deactivated interlock apparatus, system, and method for enabling the installation of an installable device only when configured with a required component.

In one aspect of the present invention, a component deactivated apparatus for enabling the installation of an installable device configured with a required component is presented. The apparatus includes a plunger, a stop barrier, and an actuator. In one embodiment, the plunger is mounted upon an installable device. The plunger may extend beyond the perimeter of the installable device. The stop barrier is mounted upon a receiving device. The extended plunger contacting the stop barrier obstructs the receiving of the installable device by the receiving device. The plunger is retractable, and the actuator is attached to a required component, so that in one embodiment, the actuator retracts the plunger. The actuator may retract the plunger as the required component is attached to the installable device. The retracted plunger clears the stop barrier as the installable device is received by the receiving device.

In another aspect of the present invention, a system for a component deactivated interlock is presented. In particular, the system includes an installable device, a receiving device, and a required component for the installable device. In one embodiment, the installable device includes a plunger. The receiving device may also include a stop barrier. In addition, the required component includes an actuator. In one embodiment, the plunger extends outward beyond the perimeter of the installable device. The extended plunger contacts the stop barrier of the receiving device as the receiving device receives the installable device. The extended plunger contacting the stop barrier obstructs the installation of the installable device.

The required component is attached to the installable device, engaging the actuator of the required component with the plunger of the installable device. The actuator engaging the plunger retracts the plunger. The retracted plunger does not contact the stop barrier, allowing the receiving device to receive the installable device.

In one embodiment of the system, the installable device is a circuit board, the receiving device is a circuit board enclosure, and the required component is a safety cover for the circuit board. As the safety cover is attached to the circuit board, the actuator engages the plunger. The actuator engaging the plunger retracts the plunger. A circuit board fully enclosed with the safety cover clears the stop barrier, enabling installation in the circuit board enclosure.

A method of the present invention is also presented for enabling the installation of an installable device with a required component. The method in the disclosed embodiments substantially includes the steps necessary to carry out the functions presented above with respect to the operation of the described apparatus and system. The method includes extending a plunger mounted on an installable device to obstruct installation of the installable device, connecting a required component to the installable device, retracting the extended plunger in response to the connection of the required component with the installable device, and installing the installable device in the receiving device.

The present invention obstructs a receiving device from receiving an installable device that is not configured with a required component. Consequently, the present invention reduces damage and injury from the installation of an improperly configured installable device. The receiving device is allowed to receive the installable device configured with the required component. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1A:
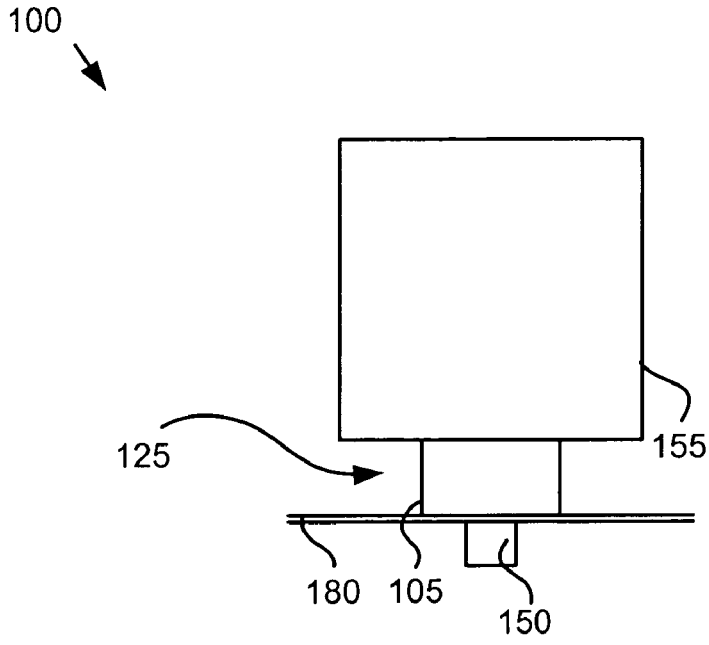
FIG. 1*a* is a front view of one embodiment of an extended plunger assembly of the present invention.

FIG. 1*a* is a front view of one embodiment of an extended plunger assembly 100 of the present invention in an extended position. The extended plunger assembly 100 includes a rod 150, an extender module 105, and a receptor module 155. The extended plunger assembly 100 is shown disposed on an installable device 180 and a space 125 exists between the receptor module 155 and the installable device 180.

In one embodiment, the extender module 105 connects to the rod 150. The rod 150 may move freely relative to the extender module 105. The extender module 105 may exert a force on the rod 150 that extends the rod 150 outward beyond the installable device 180. In a certain embodiment, the receptor module 155 is connected to the rod 150. Moving the receptor module 155 against the force exerted by the extender module 105 retracts the rod 150.

Figure 1B:
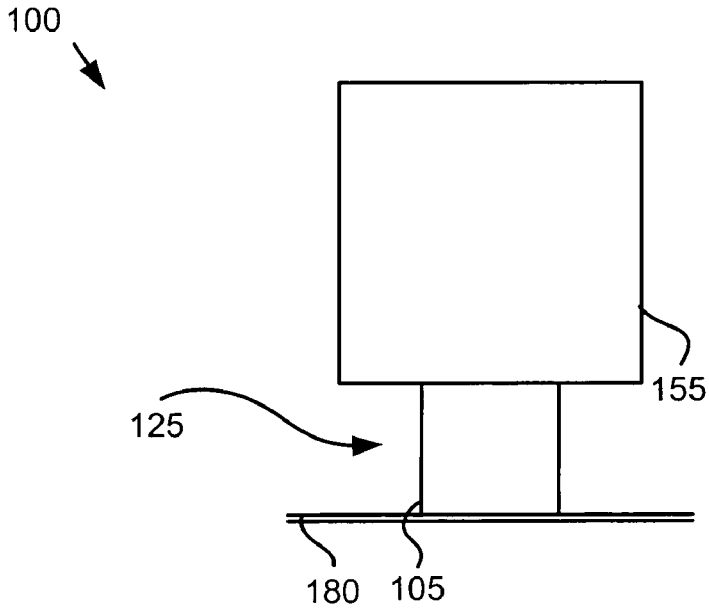
FIG. 1*b* is a front view of one embodiment of a retracted plunger assembly of the present invention.

FIG. 1*b* is a front view of the plunger assembly 100 of FIG. 1*a* in a retracted position. As depicted, the retracted plunger assembly 100 includes a rod 150, an extender module 105 and a receptor module 155. The receptor module 155 engages an actuator (not shown) disposed upon a required component (not shown). Engaging the actuator moves the receptor module 155 against the force of the extender module 105 and away from the installable device 180, retracting the rod 150. In one embodiment, the rod is retracted within the extender module 105. The plunger assembly 100 extends the rod 150 and enables the retraction of the rod 150.

Figure 1C:
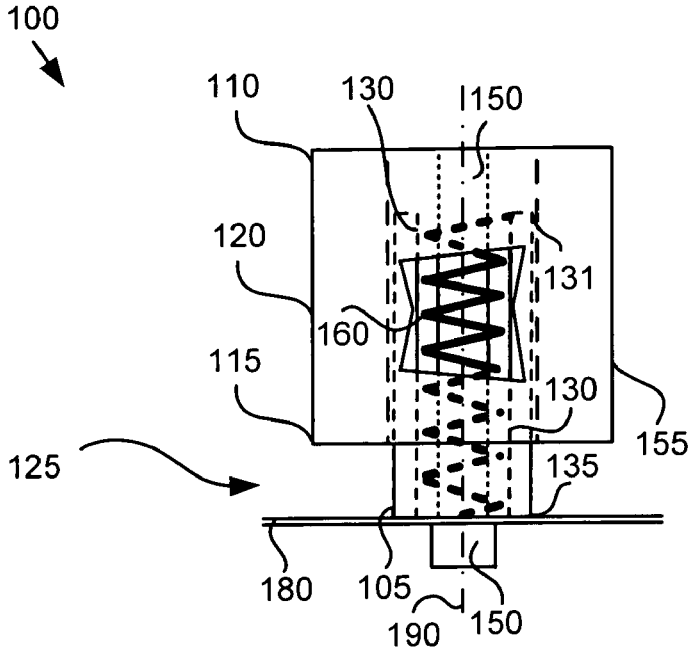
FIG. 1*c* is a cut-away view of one embodiment of an extended plunger assembly in accordance with the present invention.

FIG. 1*c* is a cut-away view of one embodiment of the plunger assembly 100 of the present invention in the extended position. The extended plunger assembly 100 extends a rod 150 to obstruct the installation of an installable device 180. As depicted, the plunger assembly 100 includes a rod 150, an extender module 105, and a receptor module 155.

In one embodiment, the extender module 105 includes a spring 160, and a spring guide. The spring 160 may connect to the spring guide. The spring guide may be an inner cylinder 130. The inner cylinder 130 preferably encloses the spring 160. In a certain embodiment, the spring 160 is connected to the rod 150. The inner cylinder 130 has a proximal end 131 and a distal end 135. In one embodiment, the spring 160 is connected to the inner cylinder 130 proximal end 131. The spring 160 applies a force along the plunger axis 190 that causes the rod 150 to extend.

In the depicted embodiment, the receptor module 155 has a proximal end 110 and a distal end 115. The receptor distal end 115 may engage an actuator (not shown). In a certain embodiment, the receptor module 155 is an outer cylinder 120. In one embodiment, the outer cylinder 120 is connected to the rod 150 at the proximal end 110 of the outer cylinder 120.

In the depicted embodiment, the outer cylinder 120 of the receptor module 155 encloses the inner cylinder 130 of the extender module 105. As shown, the inner cylinder 130 is mounted on the installable device 180. The rod 150 may move through the inner cylinder 130 and the installable device 180.

Figure 1D:
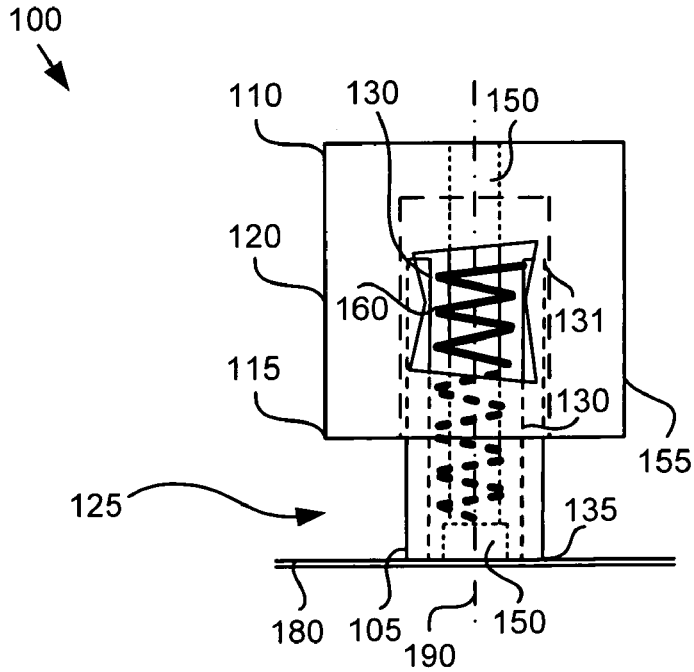
FIG. 1*d* is a cut-away view of one embodiment of a retracted plunger assembly of the present invention.

FIG. 1*d* is a cut-away drawing of the plunger assembly 100 of FIG. 1*c* in the retracted position. The plunger assembly 100 retracts the rod 150 to enable the installation of an installable device. As depicted, the outer cylinder 120 moves along the plunger axis 190 against the force of the extender module 105, retracting the rod 150. The actuator may move the outer cylinder 120 against the force of the extender module 105, retracting the rod 150 and compressing the spring 160 against the proximal end 131 of the inner cylinder 130. In one embodiment, the rod 150 is retracted into the inner cylinder 130. With the rod 150 retracted, the installable device is enabled for an installation without obstruction from the rod 150. The plunger assembly 100 extends the rod 150 and enables the retraction of the rod 150.

Figure 2:
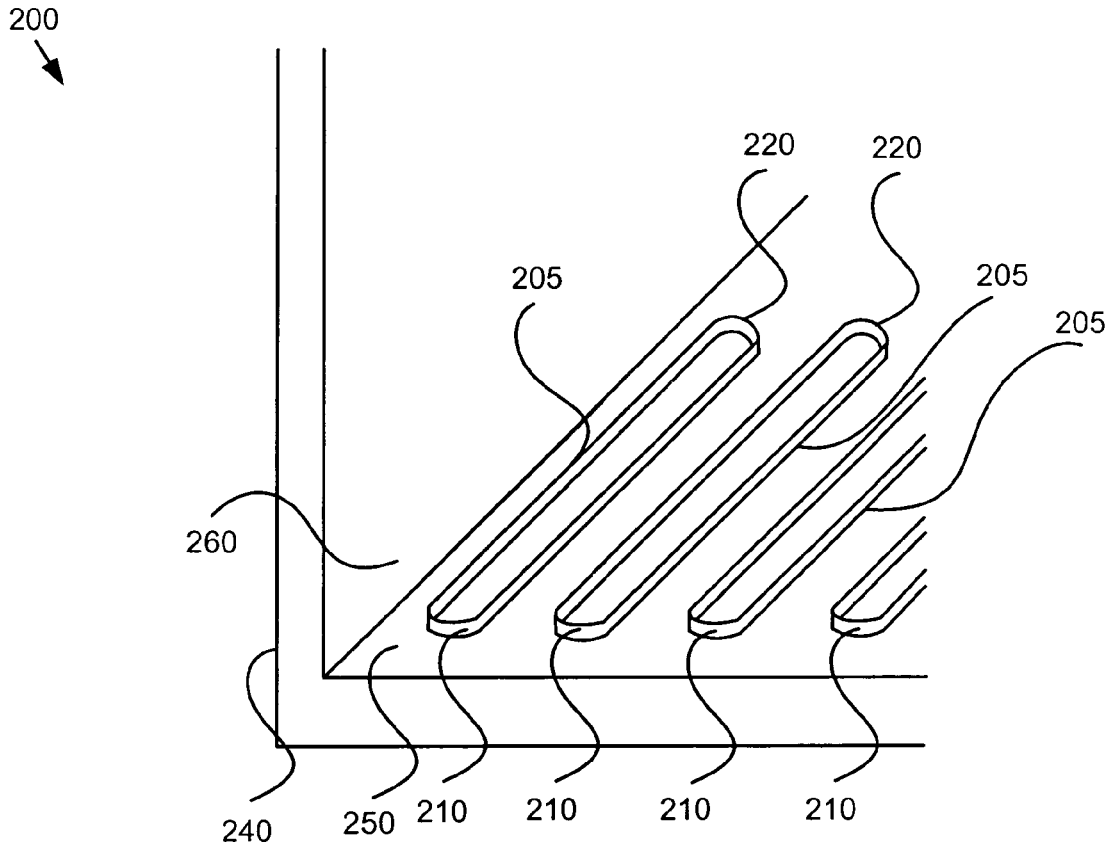
FIG. 2 is a perspective view of one embodiment of a receiving device of the present invention.

FIG. 2 is a perspective view of one embodiment of a receiving device 200 of the present invention. The receiving device 200 receives one or more installable devices. As depicted, the receiving device 200 has an outer wall 240, an inner wall 260, a base 250, and one or more stop barriers 205. The stop barrier 205 is positioned to obstruct the extended rod 150 of the plunger assemble 100 when in the extended position (not shown). In the depicted embodiment, the stop barrier 205 is disposed upon the base 250. The stop barrier 205 is preferably disposed in parallel to the inner wall 260 and may be configured with a proximal end 210 and a distal end 220. In a certain embodiment, the stop barrier 205 is a raised obstruction. In an alternate embodiment, the stop barrier 205 is an indentation with a side wall. The indentation may further be configured to allow the plunger assembly 100 to extend into it. The proximal end 210 and the distal end 220 may obstruct the movement of the extended plunger assembly 100 (not shown) perpendicular to the plunger axis 190. Although, for purposes of clarity, a single stop barrier 205 is shown disposed in parallel to the inner side wall 260 for obstructing the extended rod 150, any number of stop barriers 205 may be employed.

Figure 3:
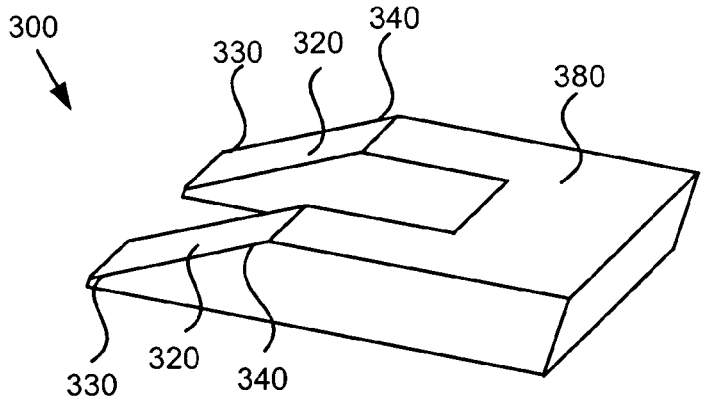
FIG. 3 is a perspective view of one embodiment of an actuator of the present invention.

FIG. 3 is a perspective view of one embodiment of an actuator 300 of the present invention. The actuator 300 is configured to enter into the space 125 and engage the plunger assembly 100 (not shown) to retract the rod 150 and thereby allow the installation of the installable device. In the depicted embodiment, the actuator 300 includes one or more prongs 320, and a receiving area 380. Although for purposes of clarity the actuator 300 is shown with two prongs, any number of prongs may be employed.

In one embodiment, each prong 320 has a proximal end 330 and a distal end 340. The proximal end 330 may be positioned and configured to contact the receptor module 155 as the actuator 300 engages the plunger assembly 100. The receptor module 155 may further move along the prong 320 toward the receiving area 380. In a certain embodiment, the receptor module 155 contacts the receiving area 380 of the fully engaged actuator 300.

Figure 4:
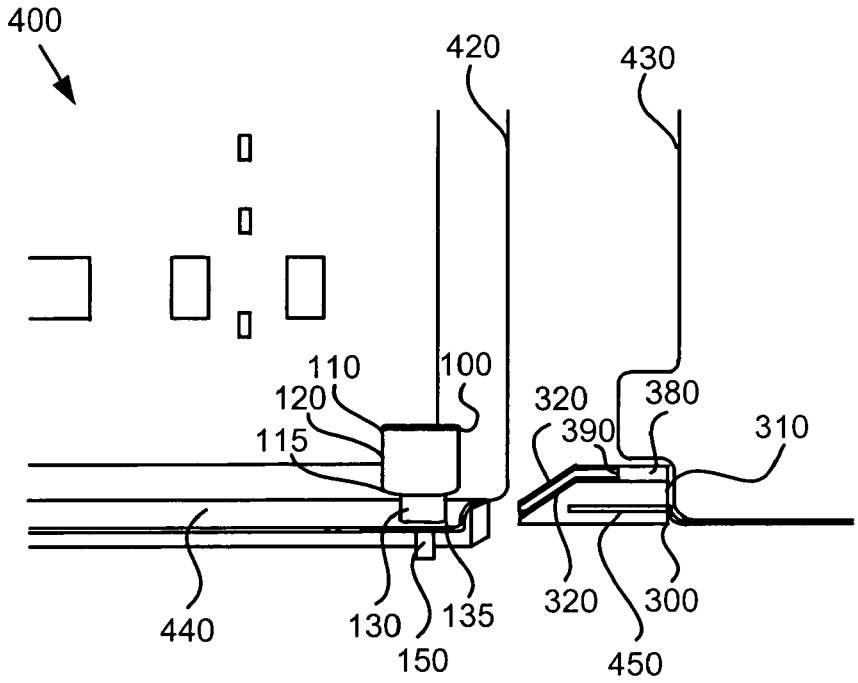
FIG. 4 is a perspective view of one embodiment of a component deactivated interlock system of the present invention.

FIG. 4 is a perspective view of one embodiment of a component deactivated interlock 400 of the present invention. As depicted, without the attachment of a required component 430, a plunger assembly 100 is extended, obstructing the receiving of the installable device 420 by the receiving device 200 (not shown). The component deactivated interlock 400 includes an installable device 420, a required component 430, a plunger assembly 100, an actuator 300, a ledge 440, and a fastener 450.

In the depicted embodiment, the installable device 420 is a circuit board. The ledge 440 is perpendicularly secured to the installable device 420. The plunger assembly 100 is mounted on the ledge 440, with the rod 150 extending beyond the installable device 420.

In the depicted embodiment, the required component 430 is a safety cover with the actuator 300 attached with the fastener 450. The prong 320 may be oriented away from the required component 430. The component deactivated interlock 400 prevents the installation of the installable device 420 lacking the required component 430. Although for purposes of clarity one plunger assembly 100 disposed upon the installable device 420 and one actuator 300 disposed upon the required component 430 are shown, any number of plunger assemblies 100 and any number of actuators 300 may be used.

Figure 5:
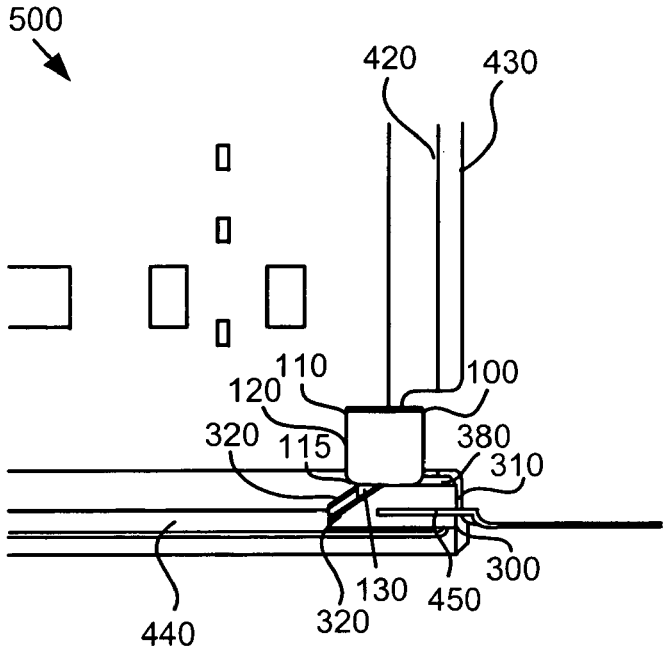
FIG. 5 is a perspective view of an alternate embodiment of a component deactivated interlock system of the present invention.

FIG. 5 is a perspective view of the component deactivated interlock 500 of the present invention with the actuator 300 engaged with the plunger assembly 100. The component deactivated interlock 500 is shown deactivated by the required component 430. In FIG. 5, the required component 430 is shown connected with the installable device 420. As the required component 430 contacts the installable device 420, the prong 320 engages the receptor module 155. In one embodiment, the prong 320 of the actuator 300 engages the outer cylinder 120. The outer cylinder 120 may move along the prong 320 until the outer cylinder 120 and the receiving area 380 of the actuator 300 are fully engaged. As a result, the rod 150 of the plunger assembly 100 retracts, enabling installation of the installable device 420. The component deactivated interlock 500 in the depicted retracted position allows the installation of the installable device 420 configured with the required component 430.

Figure 6:
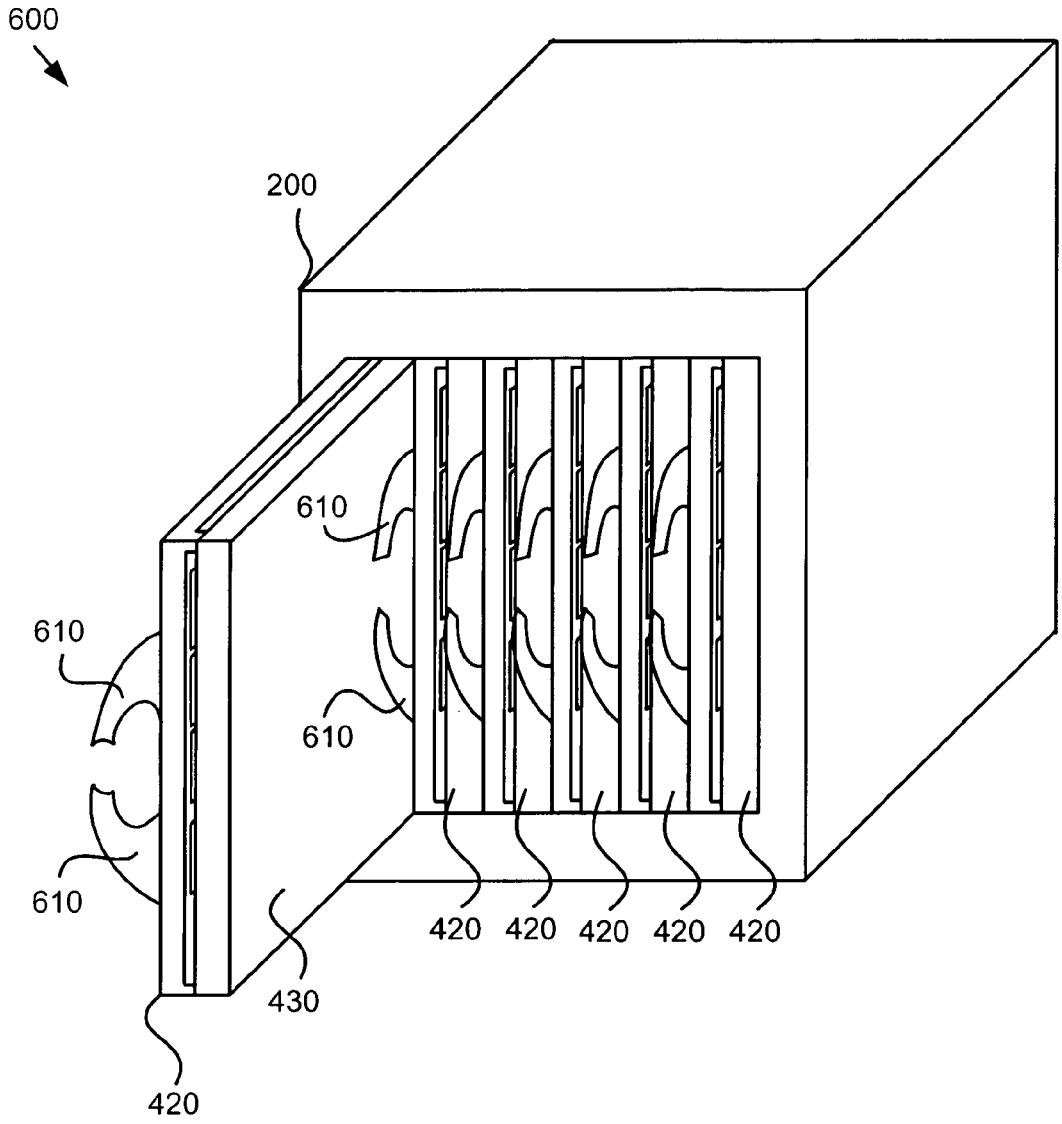
FIG. 6 is a perspective view of one embodiment of installable device installation of the present invention.

FIG. 6 is a perspective view of one embodiment of a system 600 of the present invention in which an installable device 420 is being installed. Configured with the required component 430, the installable device 420 is enabled for installation. As illustrated, the installable device 420 is a circuit board enclosed with a required component 430 in the form of a safety cover. Although for purposes of clarity each installable device 420 is shown with one required component 430, any number of required components 430 may be used.

As discussed above, the safety cover required component 430 connected to the installable device 420 retracts the rod 150 of the plunger assembly 100. In one embodiment, the receiving device 200 is a circuit board enclosure. The receiving device 200 is shown having received several installable devices 420. In one embodiment, the installable device 420 has handles 610.

Figure 7:
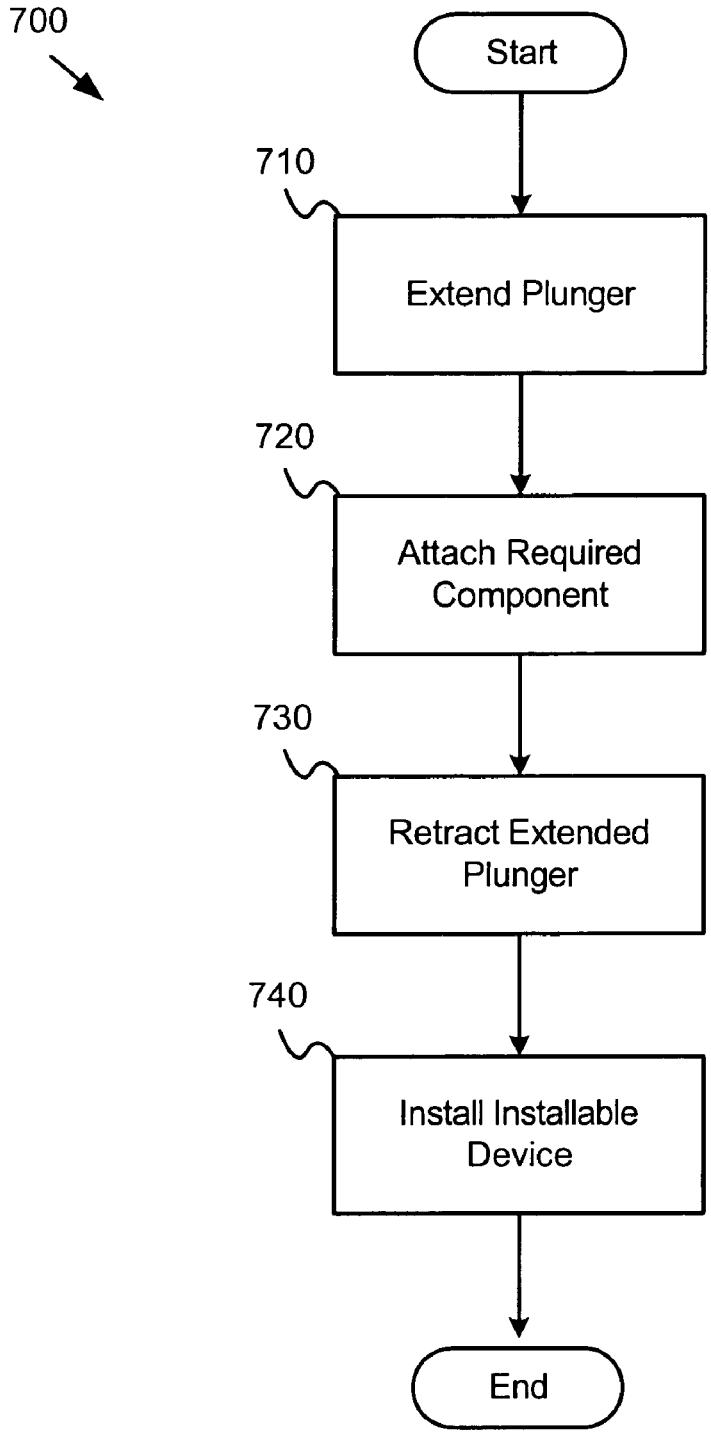
FIG. 7 is a flow chart diagram illustrating one embodiment of a component enabled installation of the present invention.

FIG. 7 is a flow chart diagram illustrating one embodiment of a component enabled installation method 700 of the present invention. The method 700 provides for a properly configured installable device 420 to be installed in a receiving device 200. The component enabled installation method 700 includes an extend plunger step 710, an attach required component step 720, a retract plunger step 730, and an install installable device step 740. Although for purposes of clarity the steps of the method 700 are depicted in a certain sequential order, execution within an actual system may be conducted in parallel and not necessarily in the depicted order.

In the extend plunger step 710 the rod 150 of the plunger assembly 100 is initially in the extended position. In the attach required component step 720 a required component 430, is attached to an installable device 420. In one embodiment, the installable device 420 is a circuit board and the required component 430 is a safety cover. In an alternate embodiment, the installable device 420 is a pneumatic device and the required component 430 is a pneumatic hose. In the retract plunger step 730, the rod 150 of the plunger assembly 100 is retracted as the required component 430 is attached to the installable device 420. In the install installable device step 740, the installable device 420 configured with the required component 430 is installed in a receiving device 200. The component enabled installation method 700 prevents the installation of the installable device 420 without a required component 430 while enabling the installation of the installable device 420 when properly equipped with the required component 430. Removing the required component 430 extends the rod 150 of the plunger assembly 100, preventing the installation of the installable device 420.

Figure 8:
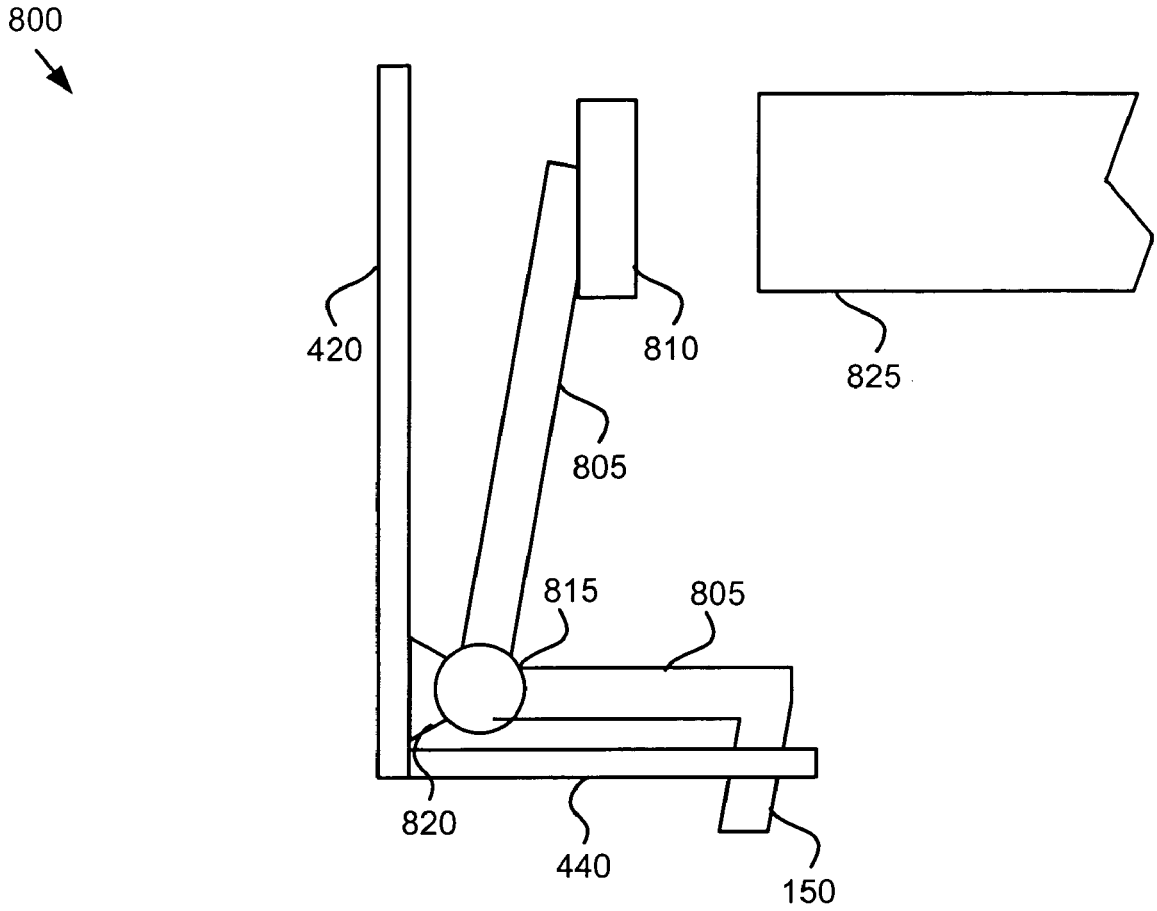
FIG. 8 is a side view drawing of one embodiment of a levered plunger assembly in accordance with the present invention.

FIG. 8 is a side view of an alternate embodiment of a levered plunger assembly 800 in accordance with the present invention. The levered plunger assembly 800 extends and retracts a rod 150. The levered plunger assembly 800 includes a rod 150, an installable device 420, a ledge 440, a lever 805, a target 810, an extender module 815, an extender base 820, and an actuator 825. The actuator is in one embodiment connected to a required component 430.

In one embodiment, the lever 805 is connected to the target 810 and the rod 150. The lever 805 may also be connected to the extender module 815. The extender base 820 may connect the extender module 815 to the installable device 420. In a certain embodiment, the extender module 815 may be spring loaded or otherwise biased to exert an angular force on the lever 805, disposing the rod 150 to extend through the ledge 440. The extended rod 150 thus obstructs the installation of the installable device 420.

When the required component 430 is in place, the actuator 825 contacts the target 810, depressing the lever 805 and thus retracting the rod 150, with the rod 150 retracted, installation of the installable device 420 is enabled.

The present invention obstructs a receiving device 200 from receiving an installable device 420 that is not configured with a required component 430. In addition, the present invention reduces damage and injury from the installation of an improperly configured installable device 420. Furthermore, the present invention allows the receiving device 200 to receive the installable device 420 configured with the required component 430.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A component deactivated interlock apparatus, the apparatus comprising:

an installable device;

a plunger disposed upon the installable device, the plunger extending to contact a stop barrier disposed on a receiving device to thereby obstruct the installable device from being received by the receiving device when a required component is not physically connected to the installable device and;

the plunger further configured to retract when the required component is physically connected to the installable device so as to clear the stop barrier when the installable device is received by the receiving device.

2. The component deactivated interlock apparatus of claim 1, further comprising an actuator in the form of a prong disposed on the required component for retracting the plunger.

3. The component deactivated interlock apparatus of claim 1, further comprising an actuator in the form of a ramp and a receiving area disposed on the required component for retracting the plunger.

4. The component deactivated interlock apparatus of claim 1, wherein the stop barrier is a raised obstruction.

5. The component deactivated interlock apparatus of claim 1, wherein the stop barrier is an indentation, the indentation configured with a side wall, the indentation further configured to allow the plunger to extend into the indentation, the side wall obstructing the movement of the plunger.

6. The component deactivated interlock apparatus of claim 1, wherein the plunger further comprises:

a rod;

an extender module configured to apply a force to the rod to cause the rod to extend;

a receptor module in physical communication with the rod, the receptor module configured to receive the actuator, the actuator moving the receptor module and the rod against the force of the extender module.

7. The component deactivated interlock apparatus of claim 6, wherein the receptor module comprises:

a lever assembly configured to move the rod in opposition to the force of the extender module; and a target disposed on the lever assembly.

8. The component deactivated interlock apparatus of claim 7, wherein an engaged actuator is configured to move the target, moving the lever assembly.

9. The component deactivated interlock apparatus of claim 8, wherein the actuator is a knob.

10. The component deactivated interlock apparatus of claim 6, wherein the extender module comprises:

a spring; and a spring guide configured to direct the force of the spring.

11. The component deactivated interlock apparatus of claim 10, wherein the receptor module and the extender module are concentric.

12. The component deactivated interlock apparatus of claim 10, wherein the spring is a coiled wire spring.

13. The component deactivated interlock apparatus of claim 10, wherein the spring is a lever spring.

14. A component deactivated interlock apparatus for enabling installation of an installable device, the apparatus comprising:

a plunger disposed upon a receiving device, the plunger configured to extend into the path of an installable device as the receiving device receives the installable device; and an actuator disposed upon a required component, the actuator configured to retract the plunger when the required component is in physical contact with the receiving device, wherein the plunger further comprises:

a rod;

an extender module configured to apply a force to the rod extending the rod;

a receptor module in physical communication with the rod, the receptor module configured to receive the actuator, the actuator configured to move the receptor module and the rod against the force of the extender module; and wherein the extender module comprises:

a spring;

a spring guide configured to direct the force of the spring.

15. The component deactivated interlock apparatus of claim 14, wherein the spring is a coiled wire.

16. The component deactivated interlock apparatus of claim 14, wherein the spring is a lever spring.

17. The component deactivated interlock apparatus of claim 14, wherein the actuator is configured as a ramp.

18. The component deactivated interlock apparatus of claim 14, further comprising a stop barrier.

19. The component deactivated interlock apparatus of claim 18, wherein the stop barrier is an indentation, the indentation configured with a side wall, the indentation further configured to allow the plunger to extend into the indentation, the side wall obstructing the movement of the plunger.

20. A system for enabling the installation of an installable device configured with a required component, the system comprising:

an installable device configured with a plunger, the plunger configured to extend, the plunger further configured to retract;

a receiving device configured to receive the installable device, the receiving device further configured with a stop barrier, wherein the stop barrier obstructing the receiving device from receiving the installable device when the plunger is extended; and a required component configured to be physically connected to the installable device, the required component further configured with an actuator positioned to cause the plunger to retract when the required component is in physical communication with the installable device.

21. The system of claim 20, further comprising a receptacle disposed within the receiving device and configured to receive an installable device.

22. A method for enabling the installation an installable device configured with a required component, the method comprising:

extending a plunger disposed upon an installable device to obstruct installation of the installable device in a receiving device;

attaching a required component to the installable device; and retracting the extended plunger responsive to the attachment of the required component.

23. The method of claim 22, further comprising installing the installable device in the receiving device.

24. The method of claim 22, wherein the plunger contacts a stop barrier to obstruct installation of the installable device.

25. The method of claim 22, wherein the plunger is retracted responsive to an actuator disposed upon the required component.

26. The method of claim 22, further comprising removing the required component, the plunger extending responsive to removing the required component.

27. The method of claim 22, wherein the extended plunger contacts a stop barrier disposed upon the receiving device, obstructing installation of the installable device.

28. An apparatus for enabling the installation of an installable device configured with a required component, the apparatus comprising:

means for extending a plunger disposed upon an installable device to obstruct installation of the installable device in a receiving device;

means for attaching a required component to the installable device; and means for retracting the extended plunger responsive to the attachment of the required component.

* * * * *

UNITED STATES PATENT AND TRADEMARK OFFICE

CERTIFICATE OF CORRECTION

PATENT NO. : 6,994,572 B2
APPLICATION NO. : 10/723111
DATED : February 7, 2006
INVENTOR(S) : Bruce E. Baker et al.

It is certified that error appears in the above-identified patent and that said Letters Patent is hereby corrected as shown below:

Column 2
Line 4, “such as safety cover” should read --such as a safety cover--.

Column 3
Line 38, “invention.” should read --invention;--.

Column 3
Line 54, “embodiment of installable” should read --embodiment of an installable--.

Column 7
Line 65, “installable device and;” should read --installable device; and--.

Column 9
Line 5, “a spring;” should read --a spring; and--.

Column 9
Line 29, “obstructing” should read --obstructs--.

Column 10
Line 1, “installation an” should read --installation of an--.

Signed and Sealed this

Fourth Day of March, 2008

JON W. DUDAS
*Director of the United States Patent and Trademark Office*